US008807342B2

(12) United States Patent
Chien et al.

(10) Patent No.: US 8,807,342 B2
(45) Date of Patent: Aug. 19, 2014

(54) PACKAGING BOX

(71) Applicant: AU Optronics Corporation, Hsin-Chu (TW)

(72) Inventors: Pei-Lun Chien, Hsin-Chu (TW); Li-Wei Chang, Hsin-Chu (TW); Hsueh-Hui Lin, Hsin-Chu (TW)

(73) Assignee: AU Optronics Corporation, Hsin-Chu (TW)

( * ) Notice: Subject to any disclaimer, the term of this patent is extended or adjusted under 35 U.S.C. 154(b) by 0 days.

(21) Appl. No.: 13/868,192

(22) Filed: Apr. 23, 2013

(65) Prior Publication Data

US 2014/0102938 A1 Apr. 17, 2014

(30) Foreign Application Priority Data

Oct. 11, 2012 (CN) ..... 2012 1 0384197

(51) Int. Cl.

| | |
|---|---|
| ***B65D 6/28*** | (2006.01) |
| ***B65D 85/30*** | (2006.01) |
| ***B65D 6/24*** | (2006.01) |
| ***B65D 81/02*** | (2006.01) |
| ***B65D 81/133*** | (2006.01) |

(52) U.S. Cl.

CPC ..... *B65D 81/022* (2013.01); *B65D 11/188* (2013.01); *B65D 81/133* (2013.01)

USPC ..... 206/523; 206/701; 220/4.21

(58) Field of Classification Search

USPC ..... 206/523, 701, 722, 723, 724, 725, 726, 206/727, 728; 220/4.21, 4.24, 4.26, 4.27

See application file for complete search history.

(56) References Cited

U.S. PATENT DOCUMENTS

| | | | | |
|---|---|---|---|---|
| 3,032,228 | A * | 5/1962 | Andrews | 220/4.24 |
| 3,252,568 | A * | 5/1966 | Steidinger | 206/403 |
| 3,346,137 | A * | 10/1967 | Ricci | 220/23.6 |
| 4,826,005 | A * | 5/1989 | Tajima et al. | 206/308.1 |
| 5,390,807 | A * | 2/1995 | Galaburda | 220/4.24 |
| 6,343,707 | B2 * | 2/2002 | Cheng | 220/4.24 |
| 6,742,655 | B2 * | 6/2004 | Kasakura | 206/592 |
| 7,114,618 | B2 * | 10/2006 | Arnold | 206/523 |
| 2006/0278555 | A1 * | 12/2006 | Langer et al. | 206/523 |
| 2008/0210588 | A1 * | 9/2008 | Stegner et al. | 206/523 |

FOREIGN PATENT DOCUMENTS

| | | |
|---|---|---|
| CN | 202030189 | 11/2011 |
| TW | I365158 | 6/2012 |

* cited by examiner

*Primary Examiner* — Jacob K Ackun
(74) *Attorney, Agent, or Firm* — WPAT, PC; Justin King

(57) ABSTRACT

A packaging box is disclosed, which is formed by coupling two packaging structures. The packaging structure includes a baseboard, which has a first side, a second side opposite to the first side, a third side for connecting the first and second sides, and a fourth side opposite to the third side for connecting the first and second sides. The packaging structure includes a first sidewall standing on the first side, and a second sidewall standing on the third sidewall. The packaging structure further includes plural first coupling elements and plural second coupling elements. The first coupling elements are disposed on the first and second sidewalls. The second coupling elements corresponding to the first coupling elements are disposed on the second and fourth sides of the baseboard. Two packaging structures are coupled by coupling the first coupling elements to the second coupling elements to obtain the packaging box.

8 Claims, 12 Drawing Sheets

10

PACKAGING BOX

RELATED APPLICATIONS

This application claims priority to Chinese Application Serial Number 201210384197.4, filed Oct. 11, 2012, which is herein incorporated by reference.

BACKGROUND

1. Field of Invention

The invention relates to a packaging box. More particularly, the invention relates to a packaging box made of an expanded plastic material.

2. Description of Related Art

In the process of transporting a general electronic product, in order to protect the electronic product from being impacted by an external force, the electronic product needs to be packaged before transportation. In general, for convenience of stacking, a packaging of the electronic product is usually box-shaped. In order to protect the electronic product, a packaging material is usually a material capable of bearing an impact from the external force, such as a presspaper, wood, Styrofoam, plastic, acryl or a combination thereof.

Additionally, in order to protect an object contained in the packaging box well, a plurality of accommodation spaces need to be formed in an internal space of the packaging box, so that the packaging box has a complex design structure and uses many fabricating materials and the assembling steps thereof are complicated, leading to disadvantages of time waste in machine shaping and increase of the cost.

Additionally, in order to protect the electronic product well, the packaging box often needs to be designed to match an appearance or dimension of the electronic product. However, after the electronic product has some changes, since the packaging box matching the electronic product no longer has a value in use, a waste of resource is caused if the packaging box is discarded directly.

SUMMARY

The invention provides a packaging box, which is used for decreasing a material used in packaging and saving a die sinking and management cost.

An aspect of the invention provides a packaging box, which is formed by coupling two packaging structures. Each of the packaging structures includes a baseboard, a first sidewall and a second sidewall. The baseboard has a first side, a second side opposite to the first side, a third side for connecting the first and second sides, and a fourth side opposite to the third side for connecting the first and second sides. The first sidewall stands on the first side. The second sidewall stands on the third side. The packaging structure further includes plural first coupling elements and plural second coupling elements. The first coupling elements are disposed on the first and second sidewalls. The second coupling elements corresponding to the first coupling elements are disposed on the second and fourth sides of the baseboard. Two packaging structures are coupled by coupling the first coupling elements to the second coupling elements.

In one or more embodiments of the invention, the first coupling element is a bump, and the second coupling element is a groove, a width of the bump reduces toward the baseboard.

In one or more embodiments of the invention, a sectional profile of the groove paralleled to the baseboard is a rectangle.

In one or more embodiments of the invention, a sectional profile of the groove paralleled to the baseboard is a parallelogram, wherein an acute angle of the parallelogram points to a corner defined by the first side and the third side.

In one or more embodiments of the invention, the packaging structure further includes plural buffer ribs, which are disposed on external surfaces of the first sidewall and the second sidewall.

In one or more embodiments of the invention, one end of the first sidewall close to the fourth side has a ladder structure, and one end of the second sidewall close to the second side has a ladder structure.

In one or more embodiments of the invention, the packaging structure further includes a buffer platform disposed on the baseboard, and an interval exists between the buffer platform and the first and second sidewalls.

In one or more embodiments of the invention, the interval between the buffer platform and the first and second sidewalls is not more than 1 centimeter.

In one or more embodiments of the invention, the buffer platform further includes plural recesses, and the recesses are disposed at the sidewall of the buffer platform.

In one or more embodiments of the invention, the buffer platform further includes strip recesses arranged in parallel, and the strip recesses are disposed on a top surface of the buffer platform.

The packaging structure is made of a single material, and this material may be recycled and reused, therefore, the material cost of the packaging structure may be reduced effectively. Two same packaging structures may be coupled to form the packaging box, therefore, the die sinking and management cost may be reduced. In addition to this, by a positional relation between the first coupling elements and the second coupling elements, this packaging box further has advantages of simple packaging steps and easy to open and cover.

BRIEF DESCRIPTION OF THE DRAWINGS

In order to make the foregoing as well as other purposes, features, advantages and embodiments of the invention more apparent, the accompanying drawings are described in detail as follows.

DETAILED DESCRIPTION

The spirit of the invention is described clearly below with reference to the drawings and detailed description. After those of skills in the art learn the preferred embodiments of the invention, variations and modifications can be made by the techniques taught in the invention without departing from the spirit and scope of the invention.

The invention provides a kind of packaging box formed by coupling two packaging structures, wherein, the two packaging structures are substantially the same element, so as to decrease the material used by the packaging box and simplify the die sinking cost.

Figure 1A:
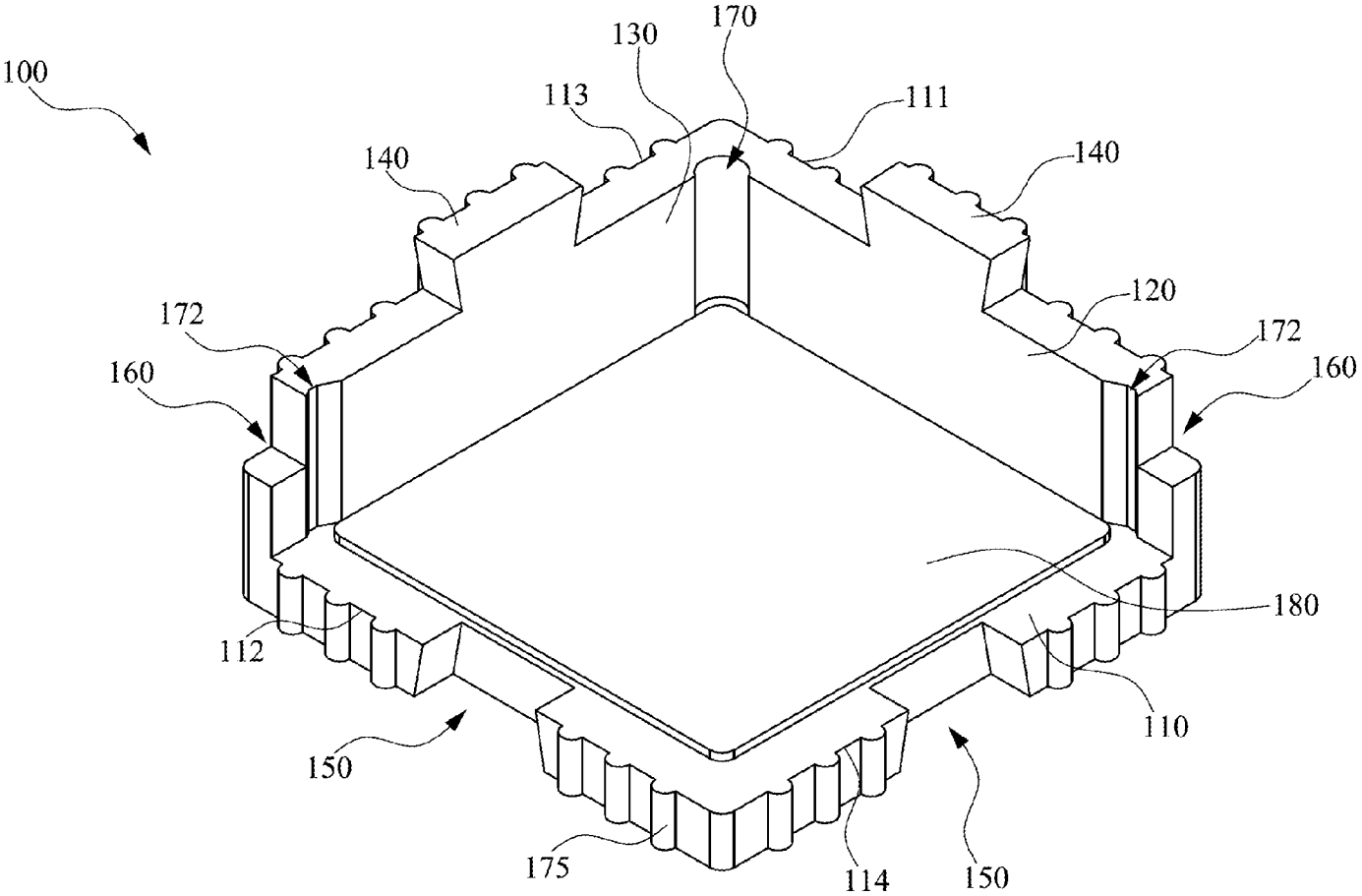
FIG. 1A is a perspective view of a first embodiment of the packaging structure applied in the packaging box of the invention.
Figure 1B:
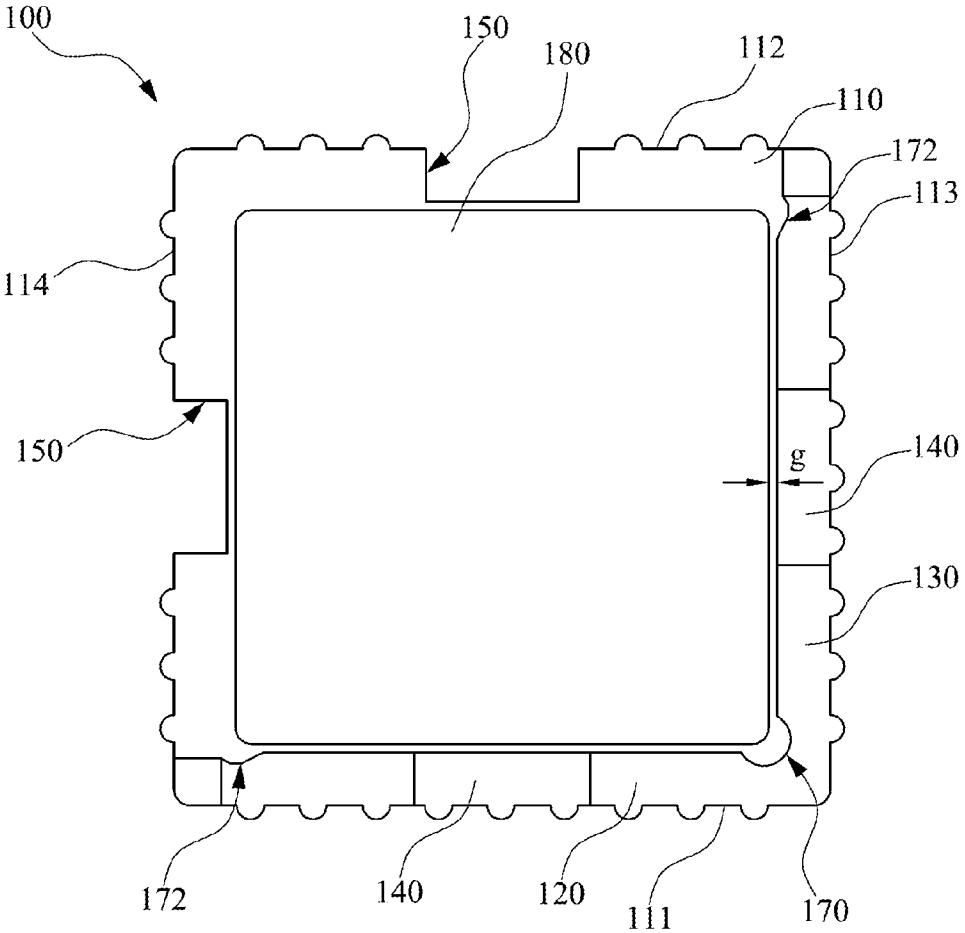
FIG. 1B is a top view of the first embodiment of the packaging structure applied in the packaging box of the invention.
Figure 1C:
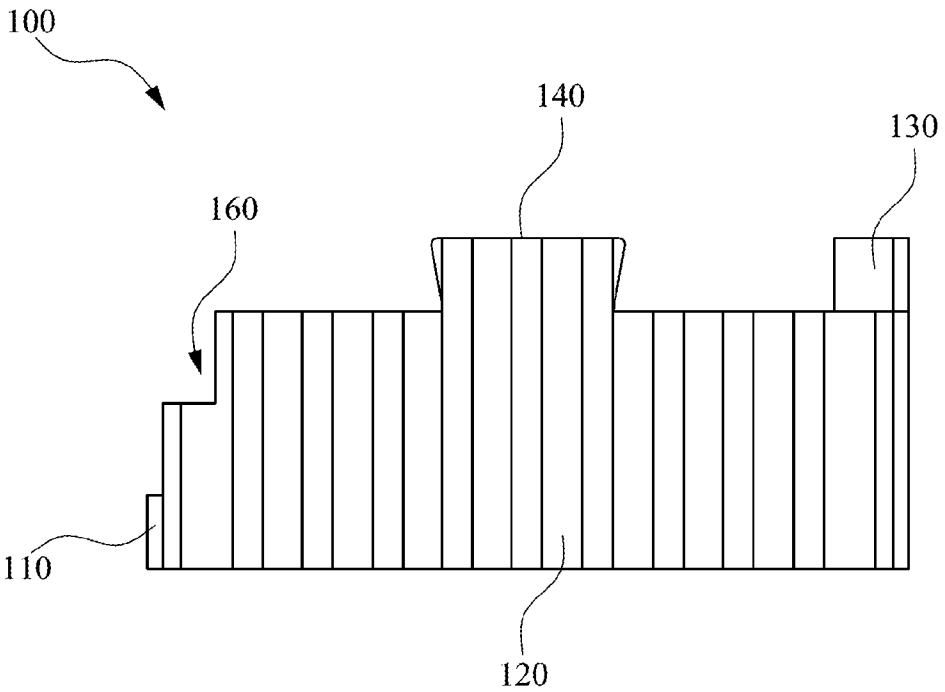
FIG. 1C is a side view of the first embodiment of the packaging structure for the packaging box of the invention.
Figure 1D:
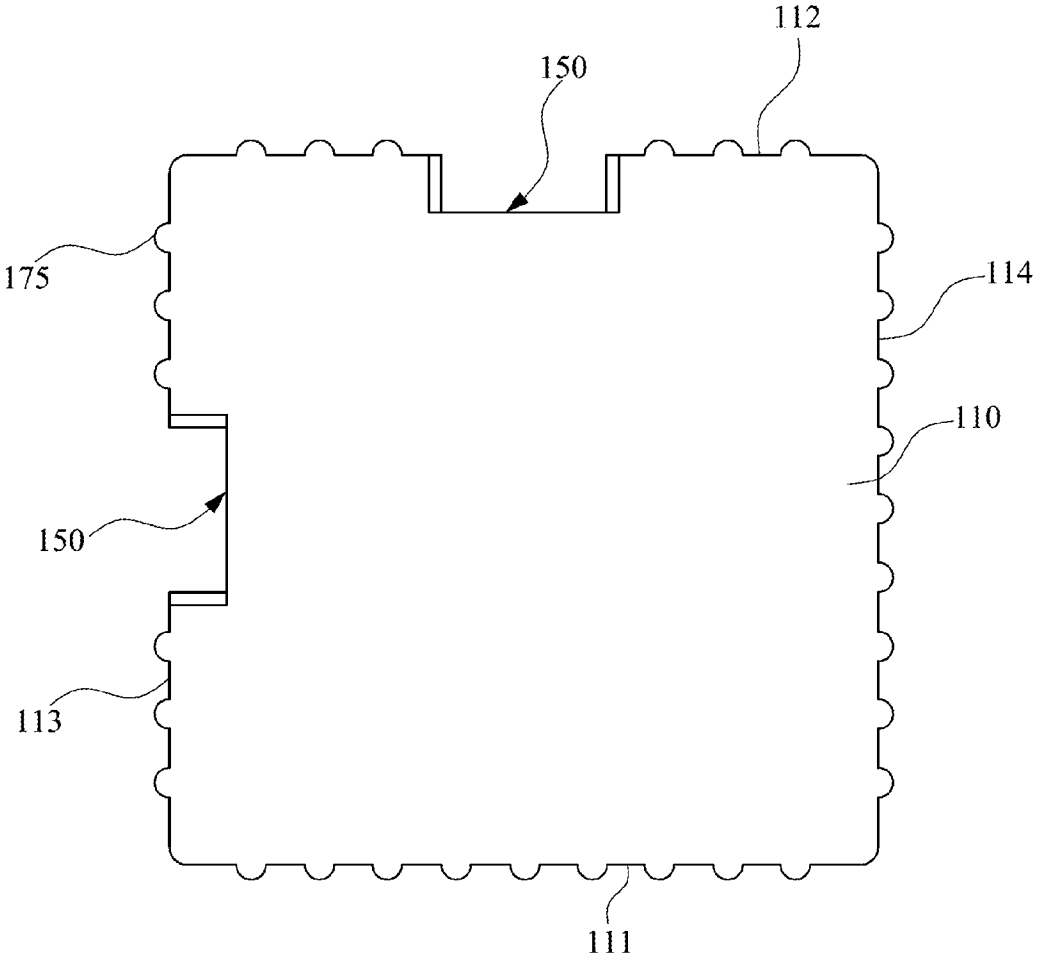
FIG. 1D is a bottom view of the first embodiment of the packaging structure for the packaging box of the invention.

Referring to FIGS. 1A to 1D, in which FIG. 1A is a perspective view of a first embodiment of the packaging structure applied in the packaging box of the invention; FIG. 1B is a top view of the first embodiment of the packaging structure applied in the packaging box of the invention; FIG. 1C is a side view of the first embodiment of the packaging structure applied in the packaging box of the invention; and FIG. 1D is a bottom view of the first embodiment of the packaging structure applied in the packaging box of the invention.

Two packaging structures 100 may be combined into one packaging box. The packaging structure 100 includes a baseboard 110, a first sidewall 120 and a second sidewall 130. The baseboard 110 has a first side 111, a second side 112, a third side 113 and a fourth side 114. The first side 111 is opposite to the second side 112; the third side 113 is used for connecting the first side 111 and the second side 112; the fourth side 114 is used for connecting the first side 111 and the second side 112; and the third side 113 is opposite to the fourth side 114. The first sidewall 120 stands on the first side 111, and the second sidewall 130 stands on the third side 113. The first sidewall 120 is further connected with the second sidewall 130 to form an L-shaped element.

The packaging structure 100 further includes first coupling elements 140, which are disposed on the first sidewall 120 and the second sidewall 130. The packaging structure 100 further includes second coupling elements 150, which are disposed on the second side 112 and the fourth side 114 of the baseboard 110. The second coupling elements 150 are disposed corresponding to the first coupling elements 140. The two packaging structures 100 are coupled by coupling the respective first coupling element 140 to the respective second coupling element 150. That is, when the two packaging structures 100 are coupled to each other, the first coupling element 140 of one of the packaging structures 100 is coupled to the second coupling element 150 of the other packaging material 100, and the second coupling element 150 of one of the packaging structures 100 is coupled to the first coupling element 140 of the other packaging material 100.

One first coupling element 140 may be respectively disposed on the first sidewall 120 and the second sidewall 130. One second coupling element 150 is also respectively disposed on the second side 112 and the fourth side 114 of the baseboard 110. The first coupling element 140 may be the bump, and the second coupling element 150 may be the groove. A shape of the bump is matched with that of the groove, so that the first coupling element 140 is coupled to the second coupling element 150.

The second coupling element 150 is the groove, and the shape of the sectional profile of the groove paralleled to the baseboard 110 is a rectangle. The first coupling element 140 is the bump, and the shape of the sectional profile of the bump paralleled to the baseboard 110 is also roughly the rectangle. In order to strengthen stability of the coupling between the first coupling element 140 and the second coupling element 150, the shape of a sectional profile of the first coupling element 140 perpendicular to the baseboard 110 may be a trapezoid wide at the top and narrow at the bottom. That is, the width of the bump reduces toward the baseboard 110, and the width of the groove reduces toward the top surface of the baseboard 110. Therefore, when the first coupling element 140 is coupled to the second coupling element 150, it can be avoided that the bump is separated from the groove easily.

The shape and number of the first coupling element 140 and the second coupling element 150 listed above are only illustrated for example, and are not intended to limit the invention. Those of ordinary skills in the art should design the shape and number of the first coupling element 140 and the second coupling element 150 flexibly according to actual requirements.

The packaging structure 100 may further include a ladder structure 160. The ladder structure 160 is located at one end of the first sidewall 120 that is not connected with the second sidewall 130. Specifically, one end of the first sidewall 120 close to the fourth side 114 has the ladder structure 160, and one end of the second sidewall 130 close to the second side 112 has the ladder structure 160. Similarly, when the packaging structures 100 are coupled pairwise, the ladder structures 160 are contacted with each other, so that the packaging structures 100 are coupled more tightly.

The object to be stored is placed in the packaging structure 100. To avoid that corners of the object is directly contacted with the packaging structure 100 to generate a concentrated stress, the packaging structure 100 may further include plural rake angle structures 170, which are disposed at the corners corresponding to the corners of the object. More particularly, the rake angle structures 170 are located at the position of where the first sidewall 120 is connected with the second sidewall 130. Moreover, outer edges of the first sidewall 120 and the second sidewall 130 also have recesses 172, so that the rake angle structures 170 are respectively formed at a junction of the first sidewall 120 and a junction of the second sidewall 130 after the two packaging structures 100 are coupled to each other. The shape of the rake angle structure 170 may be an arc.

In order to protect the object contained in the packaging structure 100 more effectively, the packaging structure 100 further includes plural buffer ribs 175. The buffer ribs 175 are disposed on external surfaces of the first sidewall 120 and the second sidewall 130. The buffer ribs 175 are protruded at the first sidewall 120 and the second sidewall 130. When the protruded buffer ribs 175 are impacted by the external force, the buffer ribs 175 may be compressed and deformed to absorb the external force, avoiding that the external force is directly transported to the object contained in the packaging structure 100.

In order to further strengthen a damping effect of the packaging structure 100, the packaging structure 100 may further include a buffer platform 180 disposed on the baseboard 110. The buffer platform 180 may be used for blocking up the object, which avoids the object from being directly stacked on the baseboard 110 and is convenient for a person to take the object on the buffer platform 180. The buffer platform 180 is protruded at the baseboard 110, so that the buffer platform 180 is compressed and deformed when subjected to the external force, to reach a buffer and shock-proof purpose. An interval g exists between the buffer platform 180 and the first sidewall 120 and the second sidewall 130. In other words, the buffer platform 180 is not directly connected with the first sidewall 120 and the second sidewall 130. The width of the interval g is not more than 1 centimeter, and a height of the buffer platform 180 is not more than 5 millimeters.

The material of the packaging structure 100 preferable is the expanded plastic material, such as Expanded Poly-Propylene (EPP), Expandable Polystyrene (EPS), Expandable Polyethylene Copolyem (EPO), and Expandable Polyethylene (EPE). The baseboard 110, the first sidewall 120, the second sidewall 130, the first coupling element 140, the second coupling element 150, the buffer ribs 175 and the buffer platform 180 are made as a whole. Since the packaging structure 100 is made of the same material, it is convenient to reduce the material management cost. In addition to this, the above-mentioned expanded plastic material further has a feature capable of being recycling and reusing.

Figure 2A:
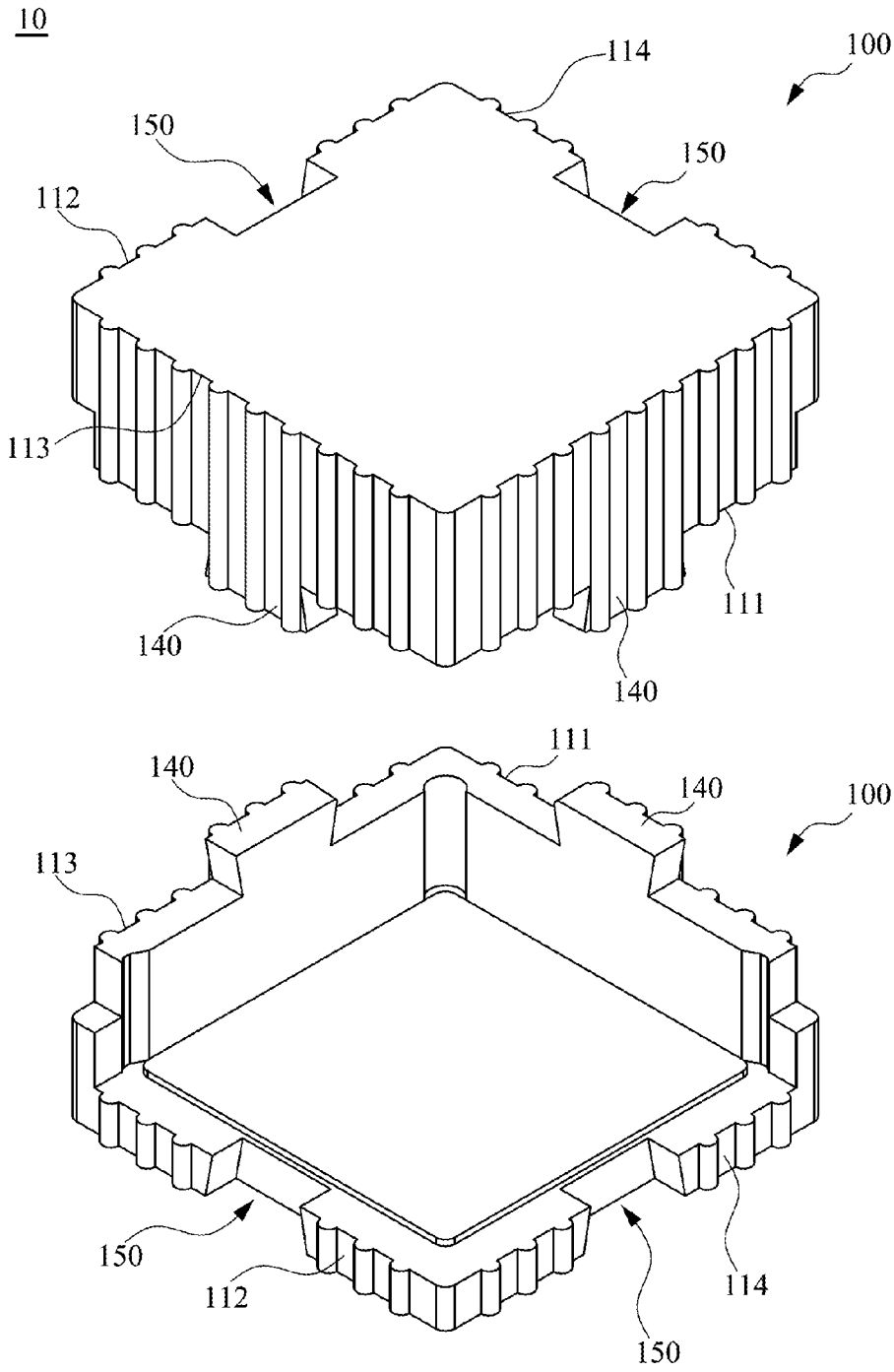
FIGS. 2A and 2B respectively show perspective views of the first embodiment of the packaging box of the invention after and before being assembled.
Figure 2B:
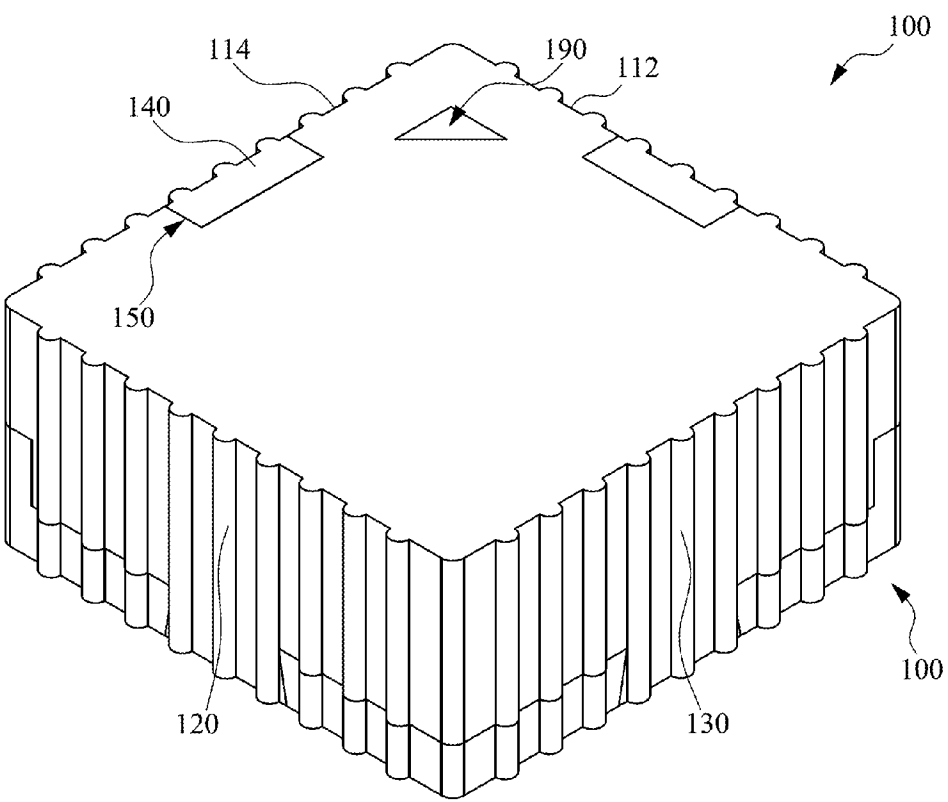

FIG. 2A and FIG. 2B are perspective views of the first embodiment of the packaging box of the invention after and before being assembled. A packaging box 10 is formed by coupling the two packaging structures 100, in which the two packaging structures 100 are substantially designed with the same element. As shown in FIG. 2A, when the two packaging structures 100 are coupled to each other, the baseboards 110 cooperate face to face. The first coupling element 140 on the first side 111 of one of the packaging structures 100 is coupled to the second coupling element 150 on the fourth side 114 of the other packaging structure 100. The second coupling element 150 on the second side 112 of one of the packaging structures 100 is coupled to the first coupling element 140 on the third side 113 of the other packaging structure 100. The first coupling element 140 on the third side 113 of one of the packaging structures 100 is coupled to the second coupling element 150 on the second side 112 of the other packaging structure 100. The second coupling element 150 on the fourth side 114 of one of the packaging structures 100 is coupled to the first coupling element 140 on the first side 111 of the other packaging structure 100.

The first sidewall 120 and the second sidewall 130 of the packaging structure 100 form the L-shaped element. The object may be placed from an opening of the L-shaped element, so that the object is difficult to impact with the first sidewall 120 or the second sidewall 130.

As shown in FIG. 2B, the two packaging structures 100 are combined into the packaging box 10 by coupling the first coupling element 140 to the second coupling element 150. Two sets of the first sidewalls 120 and the second sidewalls 130 are together used for forming the sidewall of the packaging box 10, while two baseboards 110 are respectively used for forming an upper wall and a lower wall of the packaging box 10. In other words, the two packaging structures 100 may be used as an upper cover and a lower cover respectively, and the packaging box 10 may be obtained after the upper cover and the lower cover are coupled to each other.

The packaging structure 100 may further have an indication sign 190. The indication sign 190 is disposed at the included angle between the second side 112 and the fourth side 114 for indicating a user to open the packaging structure 100 from this area with a thinner thickness.

Figure 3A:
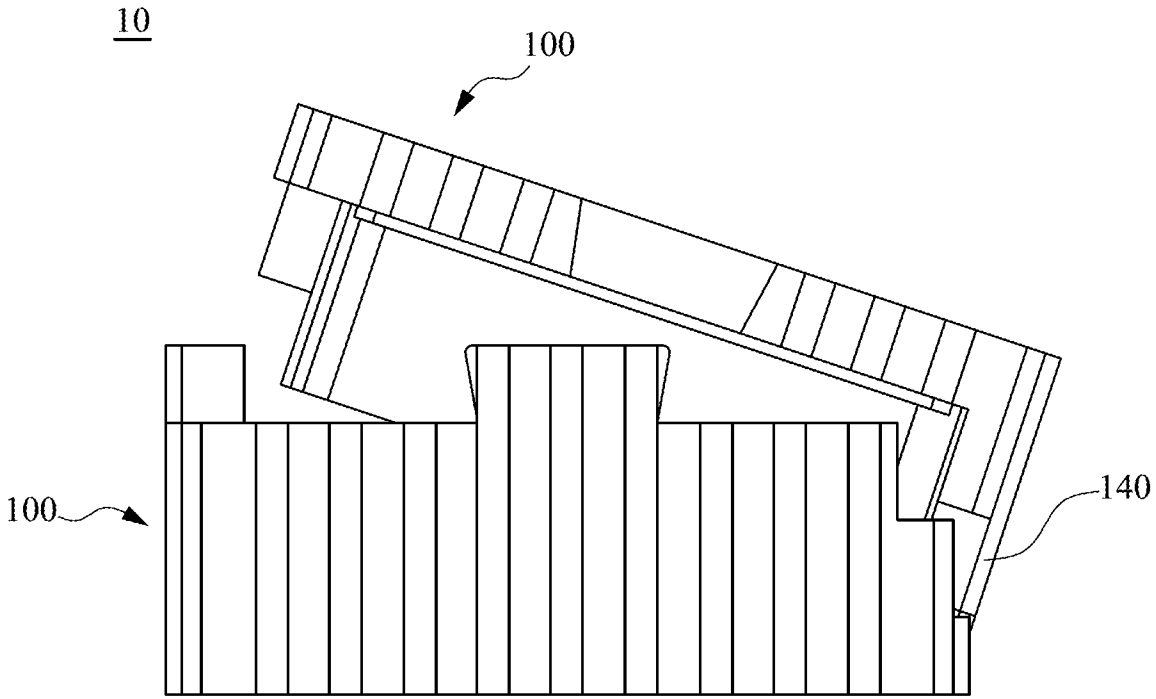
FIGS. 3A and 3B respectively show side views of the first embodiment of the packaging box of the invention at different visual angles when opening.
Figure 3B:
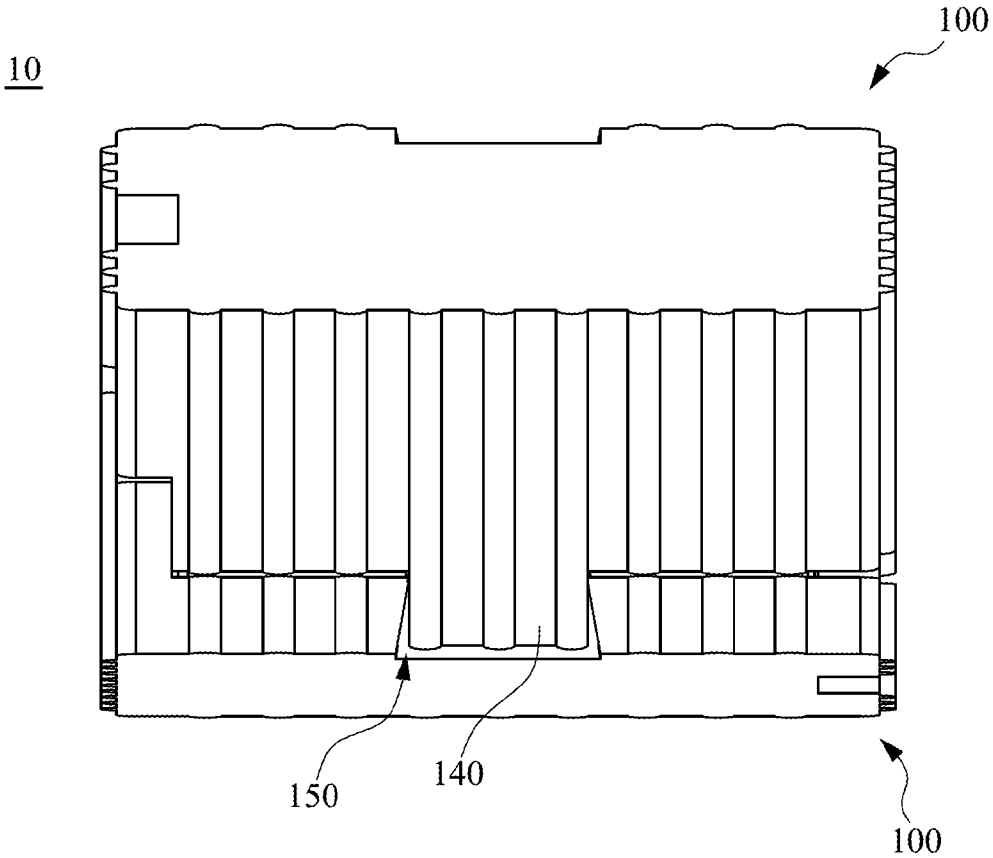

FIG. 3A and FIG. 3B are side views of the first embodiment of the packaging box of the invention at different visual angles when opening. When the packaging box 10 is opened, the packaging structure 100 as the upper cover may be opened at the indication sign 190 indicated in FIG. 2B. Now, the first coupling element 140 and the second coupling element 150 that are coupled to each other on one of the sides may act as a pivot of the packaging box 10, so that the packaging structure 100 as the upper cover is opened along a predetermined direction, and the two packaging structures 100 are still connected with each other by coupling the first coupling element 140 to the second coupling element 150 in one of the sets.

The packaging structure 100 applied in the packaging box may further have other deformations, which are illustrated specifically in the following embodiment. An illustration is performed only for a point of difference that is different from the first embodiment in the following embodiment. For the purpose of convenience on illustration, only one single packaging structure 100 is described, in practice, the two packaging structures 100 are still coupled to obtain the packaging box 10, which must be illustrated firstly.

Figure 4A:
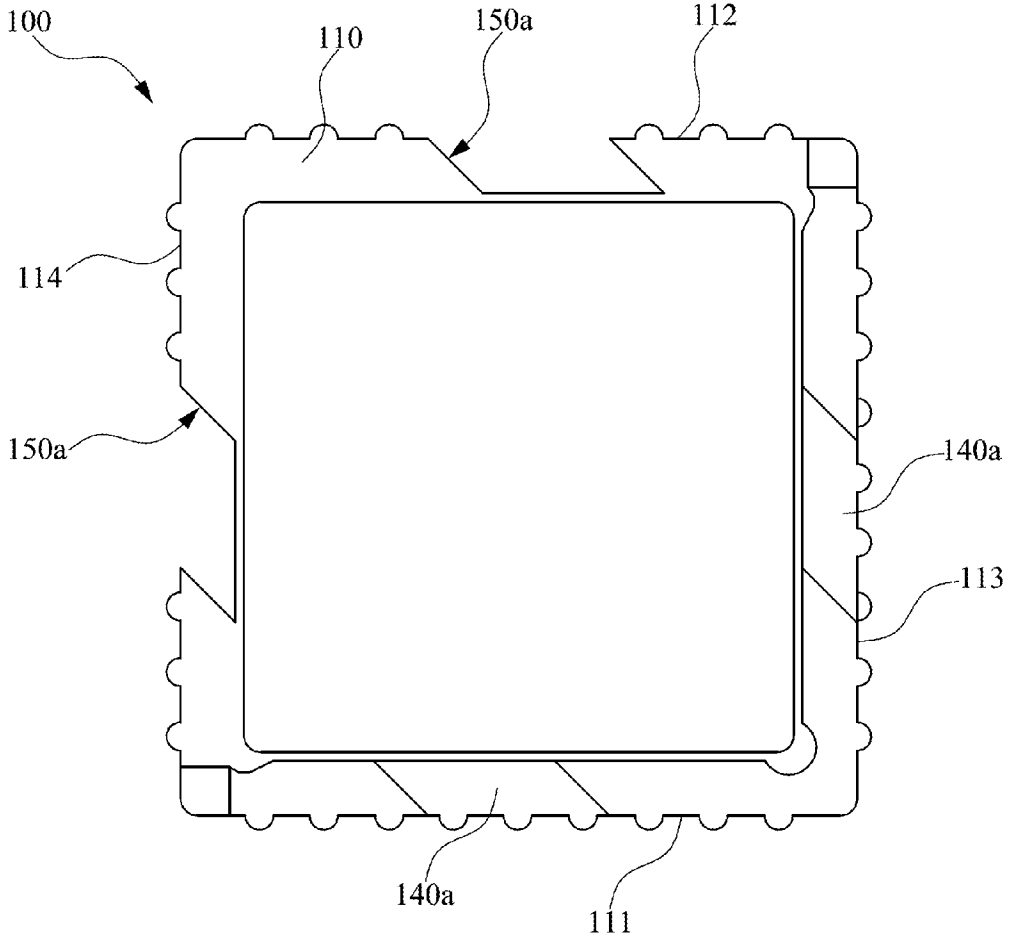
FIGS. 4A and 4B respectively show a top view and a bottom view of a second embodiment of the packaging structure applied in the packaging box of the invention.
Figure 4B:
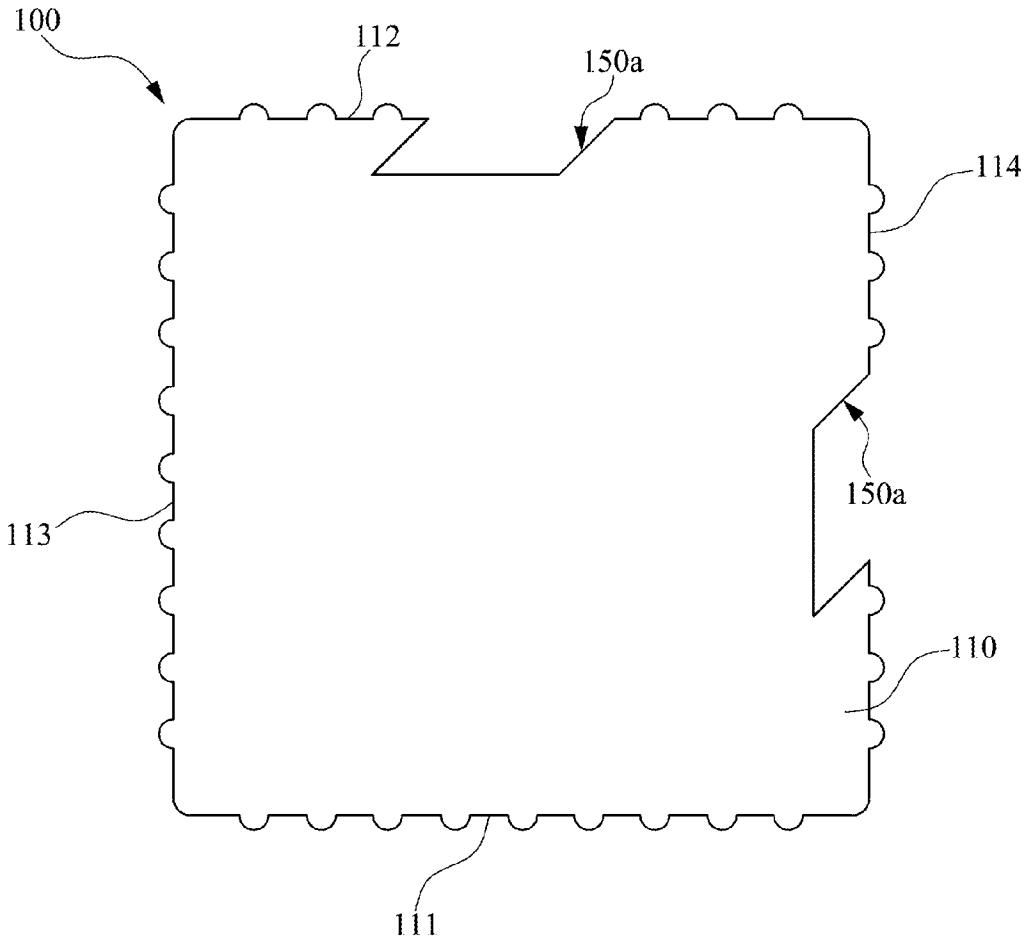

FIG. 4A and FIG. 4B are a top view and a bottom view of a second embodiment of the packaging structure applied in the packaging box of the invention. The difference between the second embodiment and the first embodiment is that, in the embodiment, a first coupling element 140*a* is the to bump, and a second coupling element 150*a* is the groove. The shape of the sectional profile of the second coupling element 150*a* paralleled to the baseboard 110 is the parallelogram. The acute angle of the parallelogram points to the corner defined by the first side 111 and the third side 113, and points to the corner defined by the second side 112 and the fourth side 114. The shape of the first coupling element 140*a* corresponds to that of the second coupling element 150*a*.

In other words, a pointing direction pointed by the first coupling element 140*a* and the second coupling element 150*a* is roughly paralleled to a diagonal line of the baseboard 110, so that the packaging box may be opened more easily along the direction pointed by the first coupling element 140*a* and the second coupling element 150*a* when the user is opening the packaging box.

Figure 5:
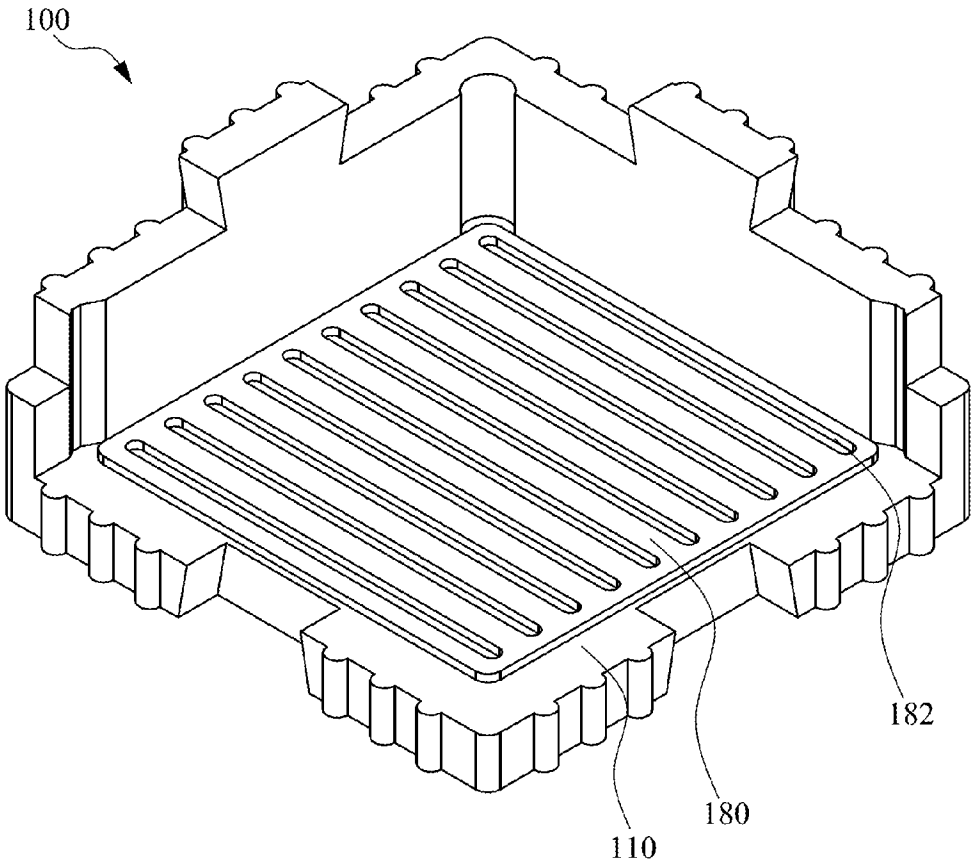
FIG. 5 shows a perspective view of a third embodiment of the packaging structure applied in the packaging box of the invention.

FIG. 5 is a perspective view of a third embodiment of the packaging structure applied in the packaging box of the invention. In the embodiment, the buffer platform 180 further includes plural strip recesses 182 arranged in parallel, and the strip recesses 182 are disposed on the top surface of the buffer platform 180. A recess depth of the strip recess 182 is approximately similar to the height protruded on the buffer platform 180. The strip recesses 182 may be used for forming an air buffer layer between the object and the baseboard 110, to further enhance the shock-proof effect of the packaging structure 100.

The shape and number of the strip recesses 182 listed above are only illustrated for example but not intended to limit the invention. Those of ordinary skills in the art should design the shape and number of the strip recesses 182 flexibly according to the actual demands. For example, the strip recesses 182 may be designed to have an equal width or unequal widths. The strip recess 182 may be disposed on the top surface of the buffer platform 180 and presented as a helix, a checkerboard or a bow shape.

Figure 6:
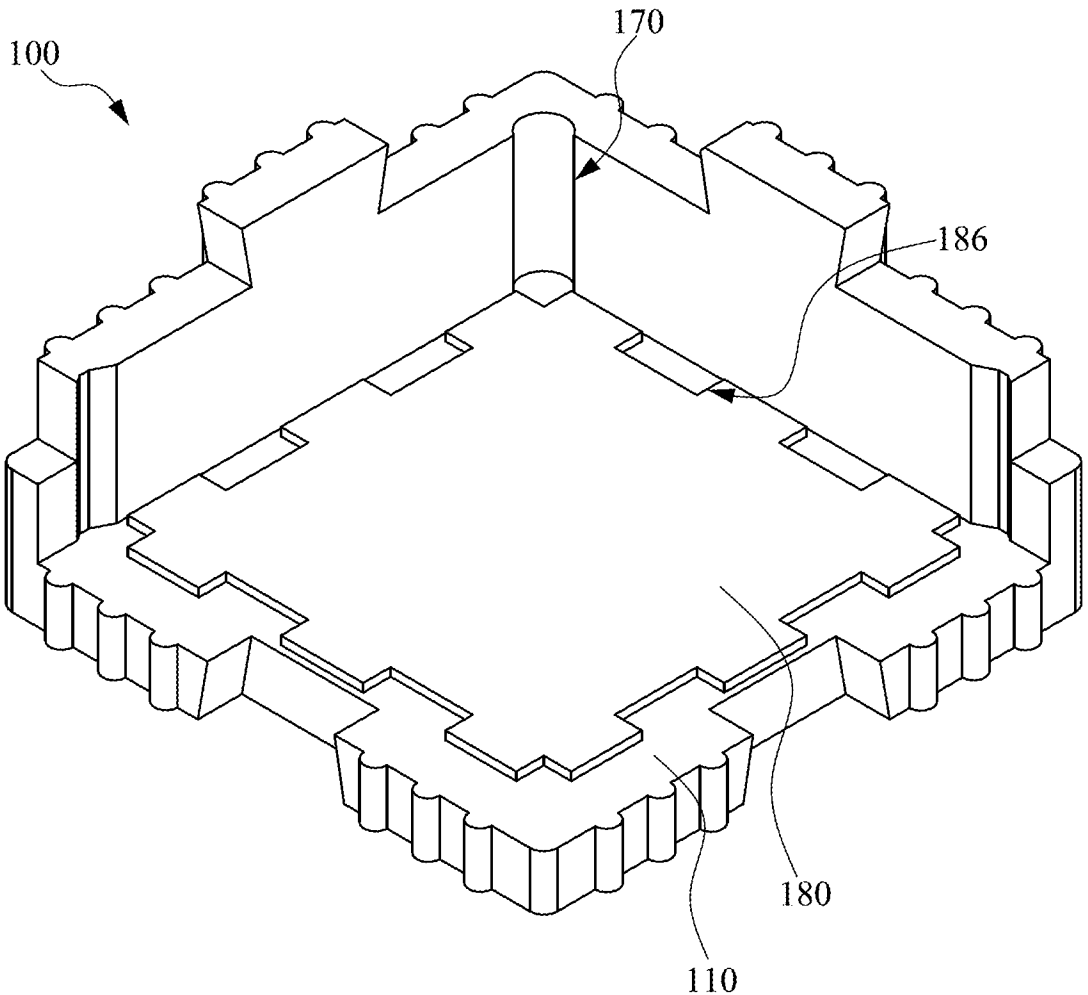
FIG. 6 shows a perspective view of a fourth embodiment of the packaging structure applied in the packaging box of the invention.

FIG. 6 is a perspective view of a fourth embodiment of the packaging structure applied in the packaging box of the invention. In this embodiment, the buffer platform 180 further includes plural recesses 186, and the recesses 186 are disposed on the sidewall of the buffer platform 180. Since the recesses 186 are disposed on the sidewall of the buffer platform 180, in addition to forming an air buffer layer between the object and the baseboard 110, it may be convenient for the user's finger to stretch into the recesses 186 and take out the object located on the buffer platform 180. The shape of the recess 186 may be the rectangle, and the recesses 186 may be distributed uniformly on the buffer platform 180. The recess 186 located at the corner of the buffer platform 180 may further cooperate with the rake angle structure 170 to provide a better protective effect.

The shape and number of the recesses 186 listed above are only illustrated for example, and are not intended to limit the invention. Those of ordinary skills in the art should design the shape and number of the recesses 186 flexibly according to the actual demands. For example, the recess 186 may have a regular shape or an irregular shape, and the number of the recesses 186 on each side of the buffer platform 180 may be one or more. The recesses 186 may also be used by cooperating with the strip recesses 182 in the previous embodiment.

It can be seen from the above embodiments of the invention that, applying the invention has the following advantages. The packaging structure is made of a single material which can be recycled and reused. Therefore, the to material cost of the packaging structure can be reduced effectively. Two same packaging structures may be coupled to form the packaging box, so as to reduce the die sinking and management cost. Additionally, by the positional relation between the first coupling elements and the second coupling elements, this packaging box has the advantages of simple packaging steps and is convenient for opening and covering.

Although the invention has been disclosed above with reference to one preferred embodiment, the preferred embodiment is not intended to limit the invention. Those of skills in the art can make various modifications and variations without departing from the spirit and scope of the invention. Therefore, the scope of the invention shall be defined by the appended claims.

What is claimed is:

1. A packaging box formed by coupling two packaging structures, wherein each of the packaging structures comprises:

a baseboard comprising:

a first side;

a second side opposite to the first side;

a third side for connecting the first side and the second side; and a fourth side opposite to the third side, for connecting the first side and the second side;

a bugger platform disposed on the baseboard, wherein the buffer platform comprises a plurality of strip recesses arranged in parallel, and the strip recesses are disposed on a top surface of the buffer platform;

a first sidewall standing on the first side;

a second sidewall standing on the third side, wherein an interval exists between the buffer platform and the first and second sidewalls;

a plurality of first coupling elements disposed on the first sidewall and the second sidewall; and a plurality of second coupling elements corresponding to the first coupling elements, disposed on the second side and the fourth side of the baseboard, whereby the two packaging structures are coupled by coupling the first coupling elements and the second coupling elements of one packaging structure to the first coupling elements and the second coupling elements of the other packaging structure.

2. The packaging box of claim 1, wherein the first coupling elements are a plurality bumps, and the second coupling elements are a plurality of grooves, and a width of each of the bumps reduces toward the baseboard.

3. The packaging box of claim 2, wherein a sectional profile of each of the grooves paralleled to the baseboard is a rectangle.

4. The packaging box of claim 2, wherein a sectional profile of each of the grooves paralleled to the baseboard is a parallelogram, and an acute angle of the parallelogram points to a corner defined by the first side and the third side.

5. The packaging box of claim 1, wherein each of the packaging structures further comprises a plurality of buffer ribs disposed on external surfaces of the first sidewall and the second sidewall.

6. The packaging box of claim 1, wherein one end of the first sidewall close to the fourth side has a ladder structure, while one end of the second sidewall close to the second side has a ladder structure.

7. The packaging box of claim 1, wherein the interval is smaller than 1 centimeter.

8. The packaging box of claim 1 wherein the buffer platform further comprises a plurality of recesses disposed on a sidewall of the buffer platform.

* * * * *